11/21/78 XR 4,126,864

United States Patent [19]

Hopkins

[11] 4,126,864

[45] Nov. 21, 1978

[54] ICE SHIELD FOR MICRO-WAVE ANTENNA

[76] Inventor: Ben R. Hopkins, 1869 Nirvana Ave., Chula Vista, Calif. 92011

[21] Appl. No.: 871,193

[22] Filed: Jan. 23, 1978

Related U.S. Application Data

[63] Continuation of Ser. No. 709,914, Jul. 29, 1976, abandoned.

[51] Int. Cl.[2] ..... H01Q 1/42

[52] U.S. Cl. ..... 343/704; 52/24; 343/872

[58] Field of Search ..... 343/704, 872, 879, 890, 343/840, 892; 52/3, 24, 86; 362/152, 290, 812

[56] References Cited

U.S. PATENT DOCUMENTS

| | | | |
|---|---|---|---|
| 3,120,640 | 2/1964 | Midlock et al. | 343/872 |
| 3,247,516 | 4/1966 | Rohn et al. | 343/890 |
| 3,381,424 | 5/1968 | Butler | 52/24 |
| 3,768,016 | 10/1973 | Townsend et al. | 343/879 |
| 3,810,187 | 5/1974 | Hai | 343/872 |

*Primary Examiner*—Eli Lieberman

*Attorney, Agent, or Firm*—Wm. Jacquet Gribble

[57] ABSTRACT

Horizontally spaced arcuate frame members are supported directly or indirectly from the tower which supports the antenna. The interval between the arcuate members is spanned by a wind-permeable cover such that the frames and the cover surround the upper portion of the antenna. Each frame member may be a complete circle or an arc of a circle. Supports such as beams join the frame members to the tower and the frame member structure is stabilized with adjustable ties connecting the frame members to the tower.

4 Claims, 9 Drawing Figures

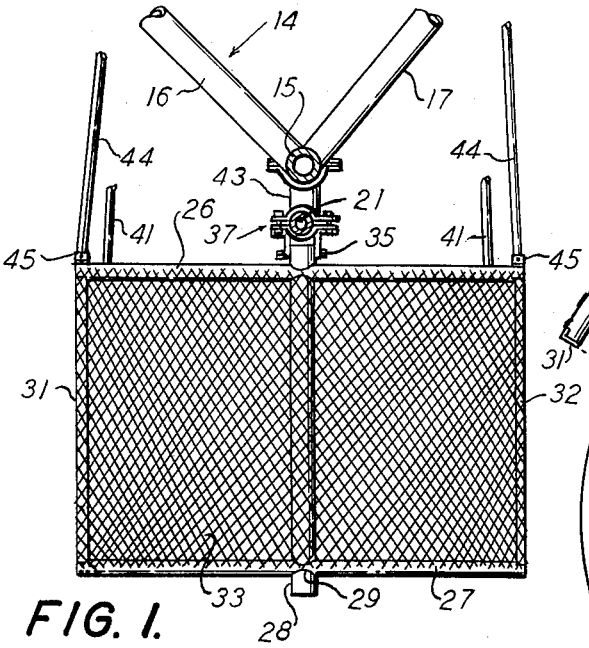
FIG. 1.
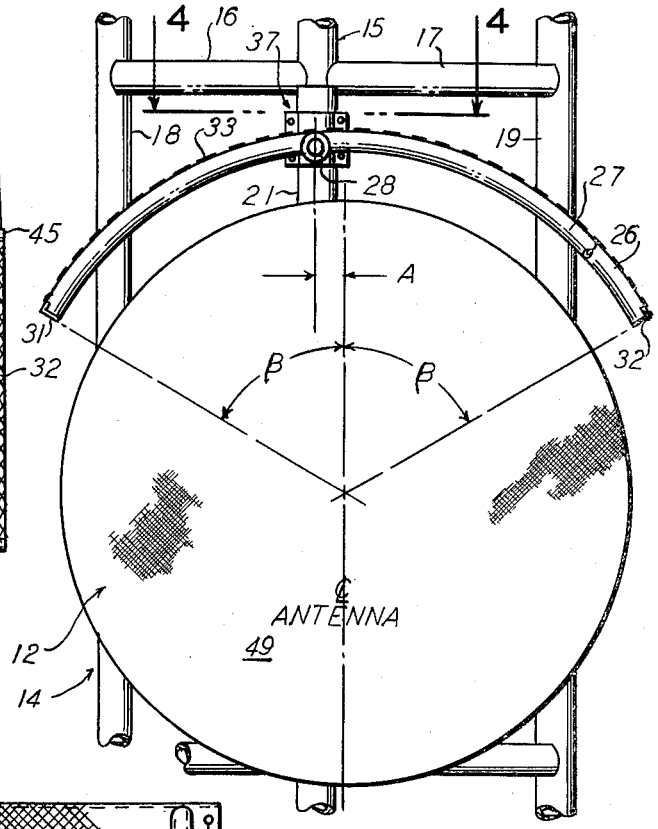
FIG. 2.
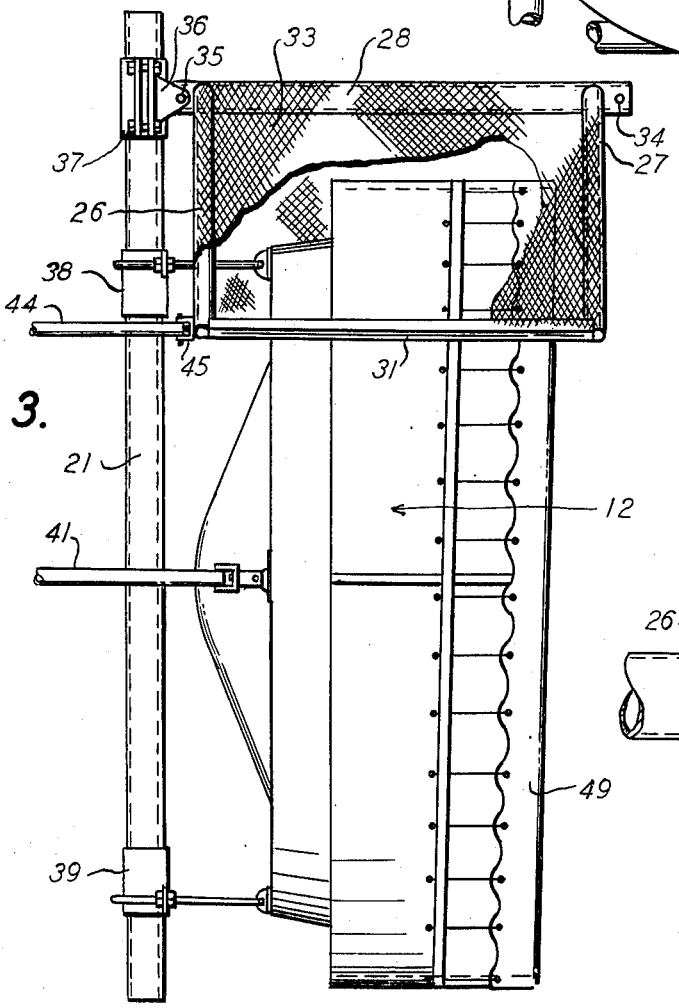
FIG. 3.
FIG. 4.
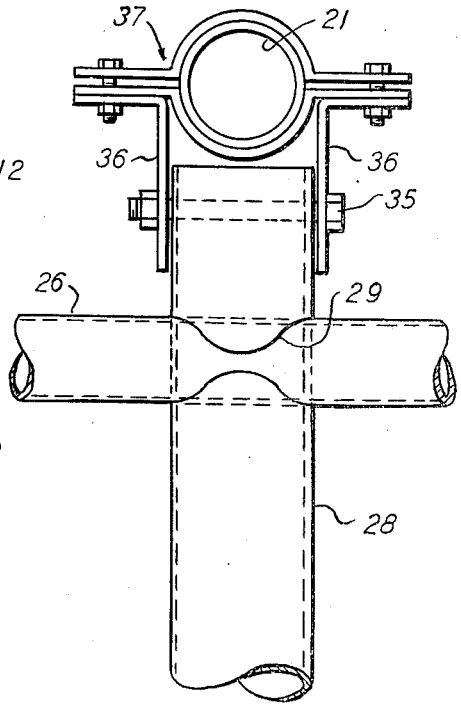

ICE SHIELD FOR MICRO-WAVE ANTENNA

BACKGROUND OF THE INVENTION

This application is a continuation of my pending application Ser. No. 709,914 filed July 29, 1976, now abandoned, and entitled: ICE SHIELD FOR MICRO-WAVE ANTENNA.

The invention relates to broadcasting and receiving antennae in the fields of micro-wave, radar, television, radio, and radio triangulation, and more particularly to shields for the antennae of such installations. The ideal transmission tower for the above wave receivers and emitters is the highest point in a given locality from which line-of-sight communication can be established to the next relay point or communication point. Of necessity such high points or places are subject to extremes of weather including snow and ice formations.

Shrouding covers have been developed in the micro-wave antennae situations, for instance, wherein the micro-wave dish has its opening covered with a radio-wave transparent fabric that precludes entry of moisture into the dish of the antenna. However, it is becoming more and more common to install gangs of antennae on a single tower such that considerable structure which may gather ice and snow clusters rises above the particular antenna. Wind and temperature changes thereafter cause sizeable masses of ice and compacted snow to fall upon the lower antenna with consequent mechanical damage.

I have invented shield structure which precludes impingement of ice masses upon the upper peripheries of micro-wave and other antennae, whether the ice mass be from the tower supporting the antenna or from nearby trees or rock formations. While previous shielding attempts have been made, none provides a mechanical structure which solves the problem of direct impingement on the exterior of the antenna in a device which may be attached to the antenna support or to the tower to which the antenna support is fastened.

SUMMARY OF THE INVENTION

The invention contemplates a shield for a tower-supported antenna and comprises a pair of spaced arcuate frame members with connector means between the arcuate frame members and support means joining the members to the support for the antenna. A cover over the interval between frames shrouds the upper portion of the antenna but is spaced therefrom. In addition to the support means joining the frame members to the tower, adjustable stabilizer ties connect the frame members to the tower or other support such that the attitude of the arcuate frame members may be adjusted to coincide with the attitude of the antenna as it is aimed at or focused on a distant point with respect to the support tower. Preferably the support means comprises a saddle clamp adapted to be secured to the tower and a beam fixed to the frame members with a pivot connector between the beam and the saddle clamp. The cover is preferably a wind-permeable metal fabric such as expanded mesh to reduce wind-loading on the cover and yet preclude large particulate material from falling upon the antenna periphery.

The antenna shield is fabricated from readily obtainable commercial materials and is flexible in its installation with respect to the attitude of the antenna. It is an effective barrier to physical damage to the antenna from wind-blown or falling materials of any sort.

These and other advantages of the invention are apparent from the following detailed description and drawing.

BRIEF DESCRIPTION OF THE DRAWING

FIG. 1 is a fragmentary plan view of the shield in accordance with the invention in place on a tower about a micro-wave antenna;

FIG. 2 is a schematic elevation, partly broken away, of the shield of FIG. 1;

FIG. 3 is a side elevation of the embodiment of FIG. 1, partly broken away to show the antenna dish;

FIG. 4 is a fragmentary plan view to a larger scale taken along line 4—4 of FIG. 2;

In the various figures like parts are identified by like numerals.

DESCRIPTION OF THE PREFERRED EMBODIMENTS

Figure 5:
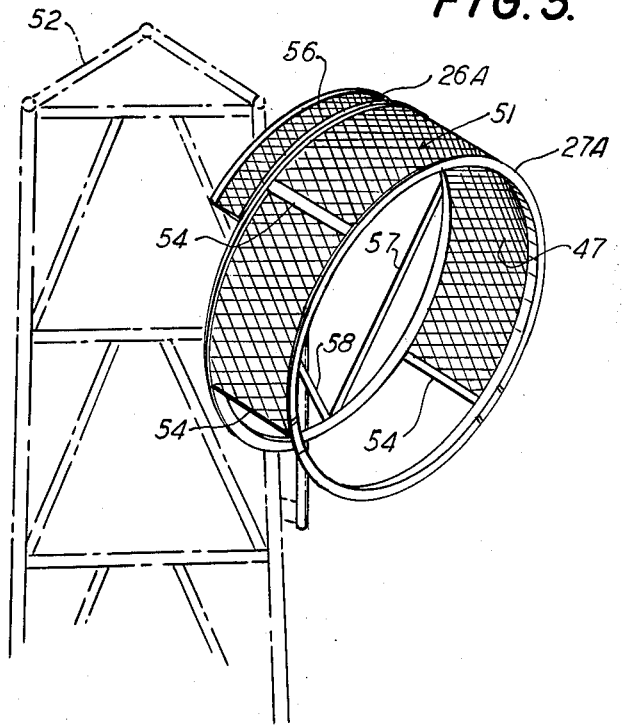
FIG. 5 is a perspective view of an alternate embodiment of the invention.
Figure 7:
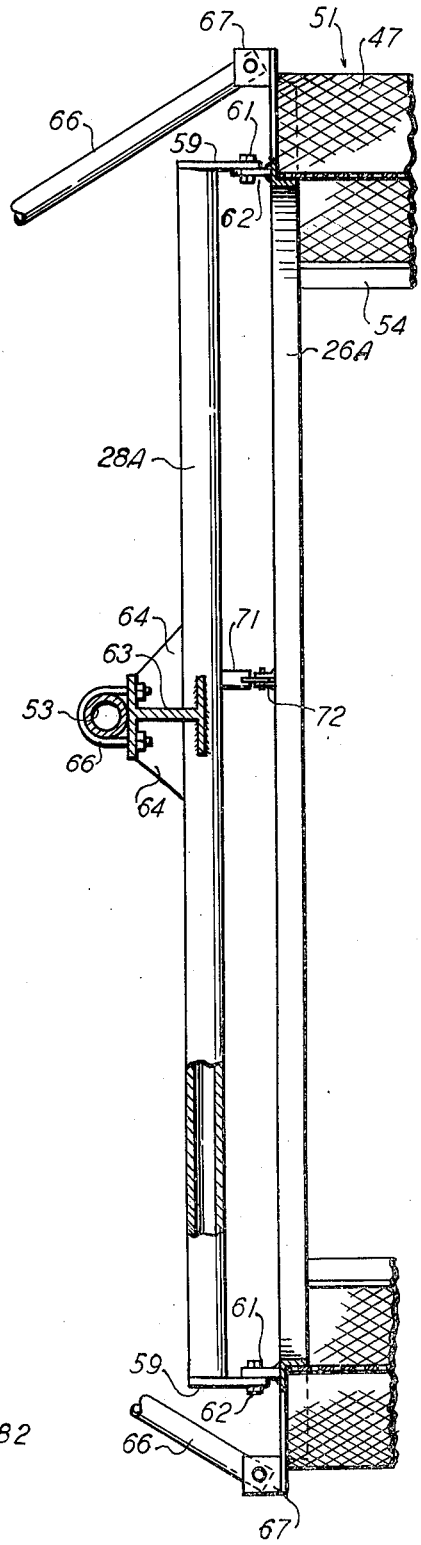
FIG. 7 is a fragmentary plan section taken along line 7—7 of FIG. 6.

FIGS. 1 through 4 show a shield 11 for a micro-wave antenna 12 which is supported by a tower structure 14 shown fragmentarily in the Figures. In FIG. 1 an adjacent upright 15 of the tower and lateral braces 16, 17 are fragmentarily shown. The same tower members are shown in FIG. 2, as are the second and third uprights 18 and 19 of the tower structure. The tower structure forms no part of the invention and is therefore not shown in detail.

As can be seen from FIG. 1, an antenna post 21 is fixed to upright 15 of the tower by means of an intermediate beam 23 and a saddle clamp assembly 24. Two or more such beams and clamps may be used. Post 21 holds ice shield 11 which comprises arcuate frame members 26 and 27 spaced apart horizontally a distance somewhat greater than the depth of the micro-wave antenna 12. In the embodiment shown in FIG. 1, the frame members describe an arc of about 120°, the arcs shown as "Beta" on each side of the vertical center line in FIG. 2 each equalling about 60°.

Both frame members are supported by a horizontal beam 28 in which each is embedded. Preferably the beam is cut out at 29 such that the frame members may be passed through and fastened, as is clearly shown in the enlarged view of FIG. 4.

It may be necessary in some instances to offset beam 28 from the center line of the arc of the frame members and of the antenna the distance "A" as shown in FIG. 2 to eliminate interference with the mounting means for the antenna. Frame members 26, 27 are connected at their ends by angle braces 31, 32 which, together with beam 28, afford a rigid structure to which a wind-permeable cover 33 is fixed. Beam 28 has a through aperture 34 at each end, the inboard aperture 34 receiving a pin 35, preferably a 1 inch diameter A-325 bolt, which pivotally connects the beam and the structure it supports to a clevis member 36 of a second saddle clamp 37. The clamp is secured to the vertical antenna post 21.

As can be seen in FIG. 3, the antenna is also secured to vertical post 21 by a pair of strap anchors 38, 39 which, with ties such as the tie 41, establish the attitude of the antenna.

The attitude of the shield, of course, should reflect that of the antenna if it is to retain close shielding proximity thereto and the pivot support of the frame members allows such attitude adjustment. The shield attitude is secured, once the antenna is fixed, by means of adjustable ties such as the ties 44 which extend to the tower from pivot mounts 45 secured to the inboard face of the arcuate frame member 26.

The ties may be strap metal but are preferably steel tubing with a clevis mount at the ends (not shown) for attachment to the tower structure.

Wind-permeable cover 33 spans the space between arcuate frame members 26, 27 from end to end. Preferably the cover is an open metallic mesh such as Ryex Standard 4.27 grating, which is welded at its edges to the frame members and to the angle iron braces 31, 32. Best results have been obtained when the frame members have been of 2½ inch diameter Schedule 40 pipe, which have provided adequate strength when supported from a 5 inch diameter Schedule 40 pipe beam.

The vertical support for the antenna and the antenna shield is normally a 4 inch pipe of the same material and both the antenna and the shield may be assembled with post 21 on the ground and then lifted into place by means of outboard aperture 34 which forms a lifting eye for a crane hook.

Alternatively, vertical post 21 may be dispensed with and saddle mounts 37, 38, 39 clamped directly to the verticals 15 of the support tower if the location of the tower laterals and the slope of the tower vertical members permit.

Antenna 12 of the illustrative FIGS. 1 through 4 is seen to be protected from weather by a mask 49 and shielded from overhead damage by shield 11. Unlike the mask, the shield is of low wind resistance and is therefore capable of fabrication into a rigid structure with minimal mechanical connection.

FIGS. 5 through 9 illustrate an alternate embodiment of the invention wherein each frame member is a complete circle. A shield 51 is mounted to a tower 52 (shown in broken lines) by means of a vertical post 53 which is secured to the tower as previously described.

Referring to FIG. 5, it can be seen that frame members 26A and 27A are closed loops of angle iron spaced apart horizontally and held together by a plurality of transverse braces 54 which may also be angle iron. 3 × 3 × 5/16 inch angle iron has proven satisfactory both for members and braces. A wind-permeable shield 47 such as that described with respect to the embodiment of FIG. 1 is welded or otherwise secured to the circular frame members 26A, 27A. The shield cover 47 extends about the frame members about 240°–270°. A smaller cover segment 56, spanning about 100°, is fixed between frame member 26A and the tower as an added shield to the antenna elements at the back. Lateral braces such as the angle braces 57, 58 further rigidify the frame members. While the frame members have been shown as continuous loops, it is understood that they may be made up of spliced segments.

A horizontal support beam 28A is pivotally mounted to frame member 26A by end plates 59 through which pivots 61 extend to be mounted into brackets 62 fixed to frame member 26A. An I-beam segment 63 is fixed as by welding to the beam 28A and is gussetted by triangular plates 64. U-bolts like the bolt 66 pass through the flange of the I-beam and surround vertical support 53 to fix the beam with respect to the support. Lateral ties 66 are pivotally secured to diametrically opposed ears 67 on the frame member 26A to further anchor the attitude of the frame member structure with respect to the tower. The tower securing ends of the ties are not shown as they form no part of the invention and may be conventional in nature.

Figure 8:
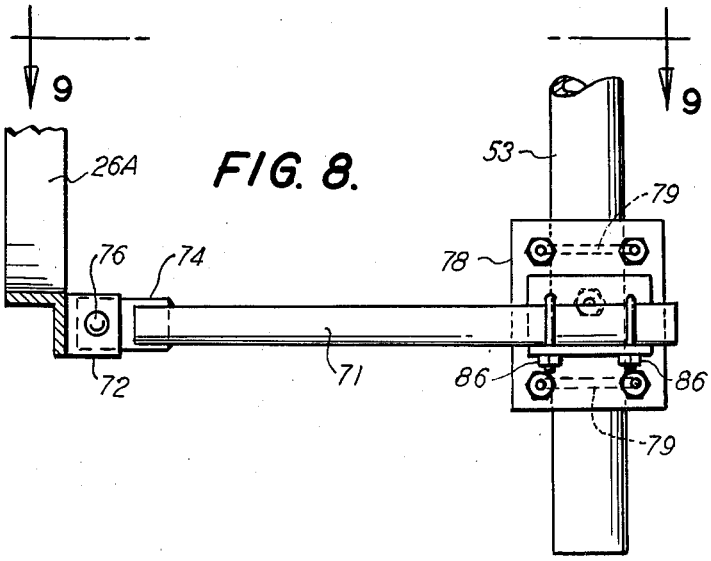
FIG. 8 is a fragmentary side view, partly in section, of an adjustable tie between a frame member and the antenna support member.
Figure 9:
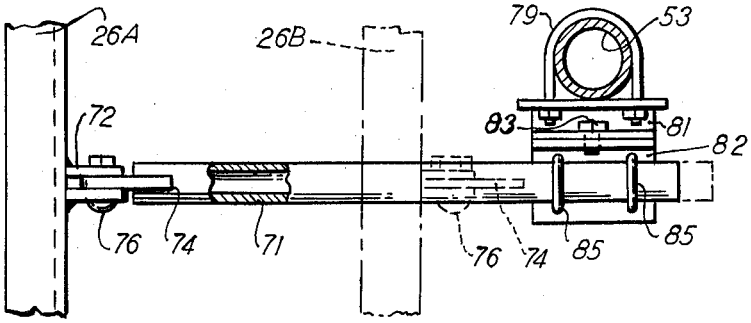
FIG. 9 is a fragmentary plan view taken along line 9—9 of FIG. 8.

A lower adjustable tie is shown in FIGS. 8 and 9. The tie rod 71 is visible in part in FIG. 7 as is the clevis mount 72 to which it is pivotally mounted. A pivot plate 74 is welded in a slot in the end of tie rod 71 and a pivot end 76 extends through the plate and clevis mount 72. The clevis mount is conventionally welded to the circular frame member 26A at the bottom point of the member. As can be seen from both FIGS. 8 and 9, a mounting plate 78 is secured to vertical support 53 by a pair of U-bolts 79. A first angle mount 81 is fixed to plate 78 and supports a second angle mount 82 preferably by means of a bolt 83 such that the second plate is pivotable with respect to the first plate. U-bolts 85 extend through the second angle mount and are adjustably secured thereto by conventional nuts.

Figure 6:
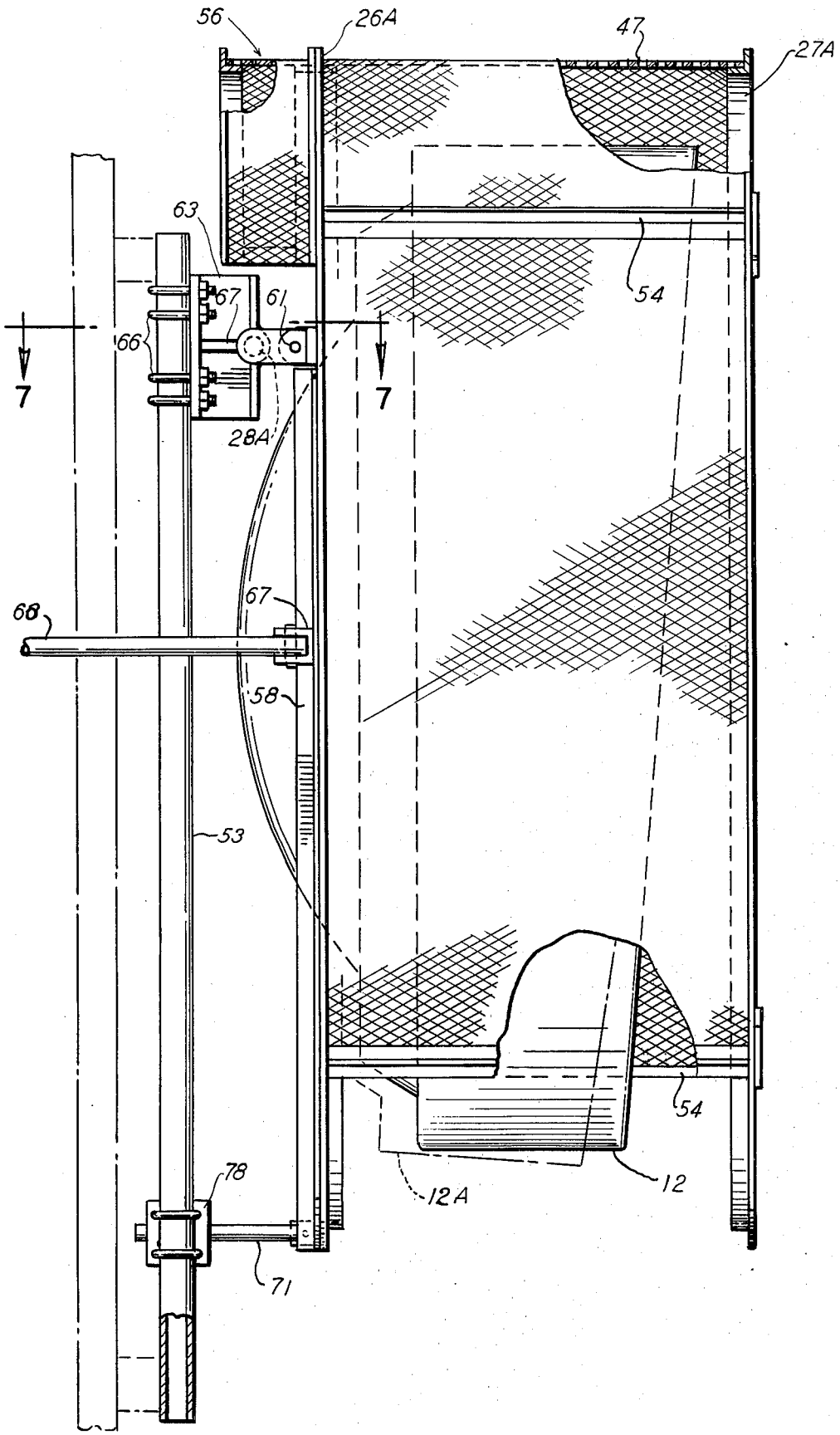
FIG. 6 is a fragmentary side elevation, partly in section, of the embodiment of FIG. 5.

Tie rod 71 is slidable within the U-bolts 81 when the nuts 86 (see FIG. 8) are loosened. The bottom of frame member 26A may be moved from the leftward position shown in FIG. 9 to the dotted rightward position 26B thereby tilting the entire frame since the two frame members are fixed together by the braces 54. The entire shield structure tilts about the pivots 61, as shown in FIG. 6, to change the attitude of the shield with respect to the vertical post 53.

The illustrative embodiments clearly show the adaptability of the antenna shield of the invention to various situations including variable tower structures and antennae of various configurations. While different embodiments have been shown to illustrate the invention, it is obvious that variations other than those shown will occur to those skilled in this art. It is therefore desired that the invention be measured by the appended claims rather than by illustrative material disclosed herein.

I claim:

1. An ice shield for an antenna supported upon a tower of tubular steel and comprising a pair of spaced, arcuate tubular frame members, connector means between the arcuate frame members, a wind-permeable perforate cover over a portion of the interval between frames, said frames and said cover shrouding at least the upper portion of the antenna at an interval therefrom; support means joining the frame members to the tower, said support means including a horizontal support beam located at a top symmetrical position fixed to the frame members, means connecting the beam to the tower, and a pivot mount between the connecting means and the beam; and adjustable stabilizer ties connecting the frame members to the tower.

2. A shield in accordance with claim 1 wherein each frame member defines a complete circle.

3. A shield in accordance with claim 1 wherein each frame member defines a segment of a circle.

4. A shield in accordance with claim 1 further comprising a bottom tie, means pivotably securing the bottom tie to a frame member, and securing means fixable to the tower support for adjustably securing the tie to the tower.

* * * * *